United States Patent [19]

Burnside

[11] 4,358,114

[45] Nov. 9, 1982

[54] REEL SPIN MECHANISM

[75] Inventor: Walter M. Burnside, Waukegan, Ill.

[73] Assignee: Bally Manufacturing Corporation, Chicago, Ill.

[21] Appl. No.: 135,535

[22] Filed: Mar. 31, 1980

[51] Int. Cl.[3] ..... A63F 5/04

[52] U.S. Cl. ..... 273/143 R; 74/469

[58] Field of Search ..... 273/143 R, 143 A, 143 B, 273/143 C, 143 D, 143 E, 138 R, 138 A, 142 R, 142 A, 142 B, 142 C, 142 D, 143 E, 143 F, 143 G, 143 H, 143 HA, 143 J, 143 JA, 143 JB, 143 JC, 143 JD, 143 K; 74/469; 194/DIG. 11, DIG. 12, 41, 50, 76, 81, 86, 89

[56] References Cited

U.S. PATENT DOCUMENTS

| | | | |
|---|---|---|---|
| 2,579,241 | 12/1951 | Nicolaus | 273/138 A X |
| 2,812,182 | 11/1957 | Fiorino | 273/143 R |
| 4,037,845 | 7/1977 | Hooker | 273/143 R X |

*Primary Examiner*—Richard J. Apley
*Assistant Examiner*—Arnold W. Kramer
*Attorney, Agent, or Firm*—Fitch, Even, Tabin, Flannery & Welsh

[57] ABSTRACT

A reel spin mechanism for use in an amusement or game device includes a reel mounted for rotation, and a disc having notches in its periphery is attached to the reel. A drive lever mechanism having a drive member at its distal end is pivotally mounted, and a system for pivoting the drive lever mechanism toward and away from the disc is provided to engage and disengage the drive member with a notch on the disc. The pivoting system effects full engagement of the drive member with a notch and then effects a few degrees of controlled rotation of the reel in a first direction of rotation. Another mechanism thereafter imparts spin to the reel in a direction opposite the first rotative direction of the reel.

20 Claims, 13 Drawing Figures

REEL SPIN MECHANISM

This invention relates generally to game devices, and more particularly relates to a mechanism for setting in rotational motion a symbol bearing reel that may be associated with a game device.

Game devices of the type which have several rotating symbol bearing reels, typically three or more of such reels, have been the subject of continued research and development through the years. While improvements have been made to such game devices, certain operational features of the devices carry a certain appeal for many players, making it desirable to retain such operational features while making improvements to the game device in order to maintain and even increase earning power of the device. For example, when a player's only part in a game is to initiate action by depressing a button, the player has little feeling of participation in the game process, realizing that once contact is made with the button, the process thereafter is totally out of the player's hands irrespective of the speed with which the button is depressed. On the other hand, in game devices having a handle outside the cabinet which initiates the game process when pulled through several degress of an arc, the player has more of a feeling of participation in the process, especially if the reels respond in a few degrees of rotational movement coincidental with the arcuate motion of the handle just prior to being launched into a full spin. In enjoying this feeling of participation, however, a player may pull the handle in amounts varying from a snappy "yank" to a slow crawl.

Moreover, there is the ever present expectation in the marketplace that features attractive to the player will be retained while devices are improved to simplify maintenance procedures, to enhance the durability of the device, and to be economical to manufacture.

Game devices having mechanisms that machanically set the reels in full spinning motion are known. At the end of a normal play cycle, the reels are sequentially stopped or "indexed" at random by electronic, electrical or mechanical means, each reel then displaying a symbol in a viewing area. Certain combinations of these symbols are regarded as winning combinations entitling the player to a score or other reward.

It is also conventional to mount the reels on a common shaft that is driven by a gear and coupled to an electric drive motor via a belt so that when a player pulls the handle or otherwise initiates operation of the device, the reels are set in motion and driven by the electric motor until sequentially stopped shortly thereafter. While the common mounting shaft is being driven, the reels are capable of slipping relative to the shaft so that toward the end of the play, the shaft may continue to be rotated while the motor is operating even though some of the reels have been stopped.

While both mechanically actuated and electrically operated game devices are known, the mechanically actuated devices are complex and expensive and their parts tend to wear. The electrically operated devices, although mechanically simpler, lack some of the player appeal features desirable in marketing the devices. Of course, stopping the reels in an abrupt manner creates significant stress or shock which causes wear to the parts as would be expected. Improved apparatus for stopping a rotatable reel of the type herein contemplated is described in co-pending application Ser. No. 970,353, filed Dec. 18, 1978, and assigned to the assignee of this invention. The invention of that application proceeds upon the basis that each reel has attached to it a rotatable disc with recessed notches in the circumference thereof, and provision is made for means for absorbing the shock that is produced when a stop arm engages a notch of the disc, thus minimizing wear on the parts and extending the useful life of the apparatus.

The present invention, on the other hand, addresses itself primarily to the actuating and rotational phase of the operation. Accordingly, it is an object of this invention to provide an improved mechanism for actuating a rotatable disc of the type which has recessed notches in the circumference thereof, which mechanism exhibits the desirable operating feature whereby a player feels participation in the game process.

Another object of this invention is to provide a mechanism for mechanically setting the rotatable disc of the aforementioned type in motion, which mechanism is simple and easily maintained.

Yet another object of this invention is to provide means for accomplishing the aforementioned objects in a physical package that will allow convenient conversion of motor driven operating mechanisms in existing game devices.

Other objects and advantages will become apparent upon reading the following detailed description in conjunction with the attached drawings in which.

Figure 12:
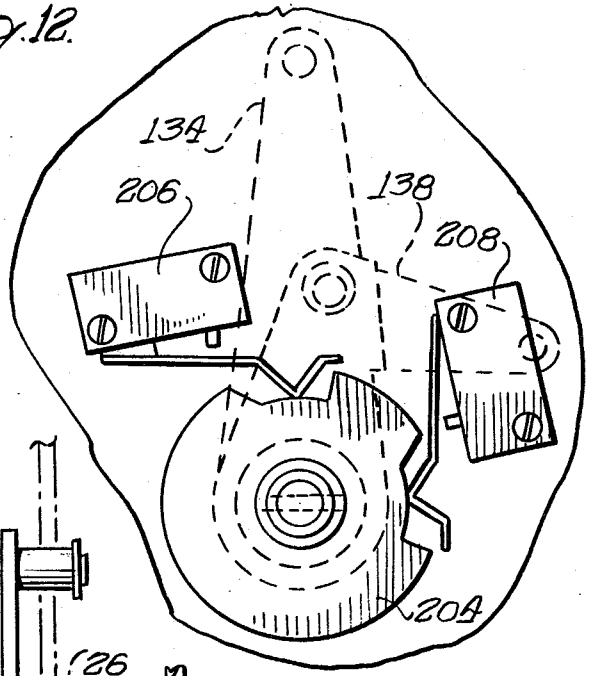
Figure 11:
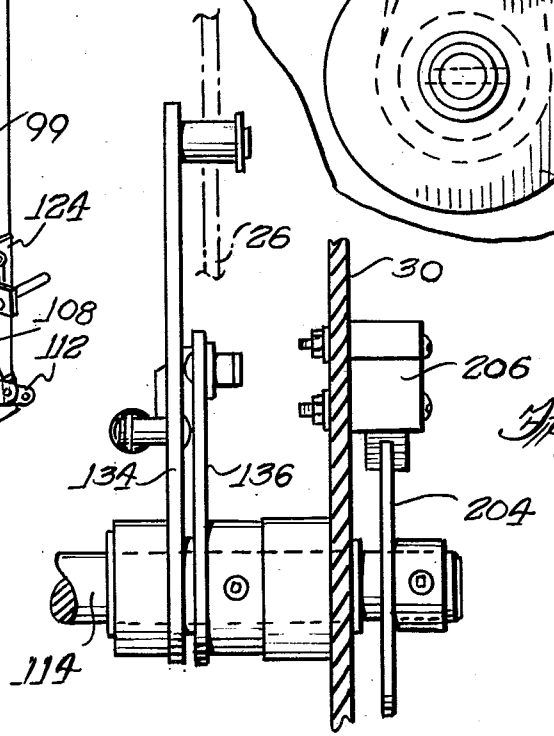
Figure 4:
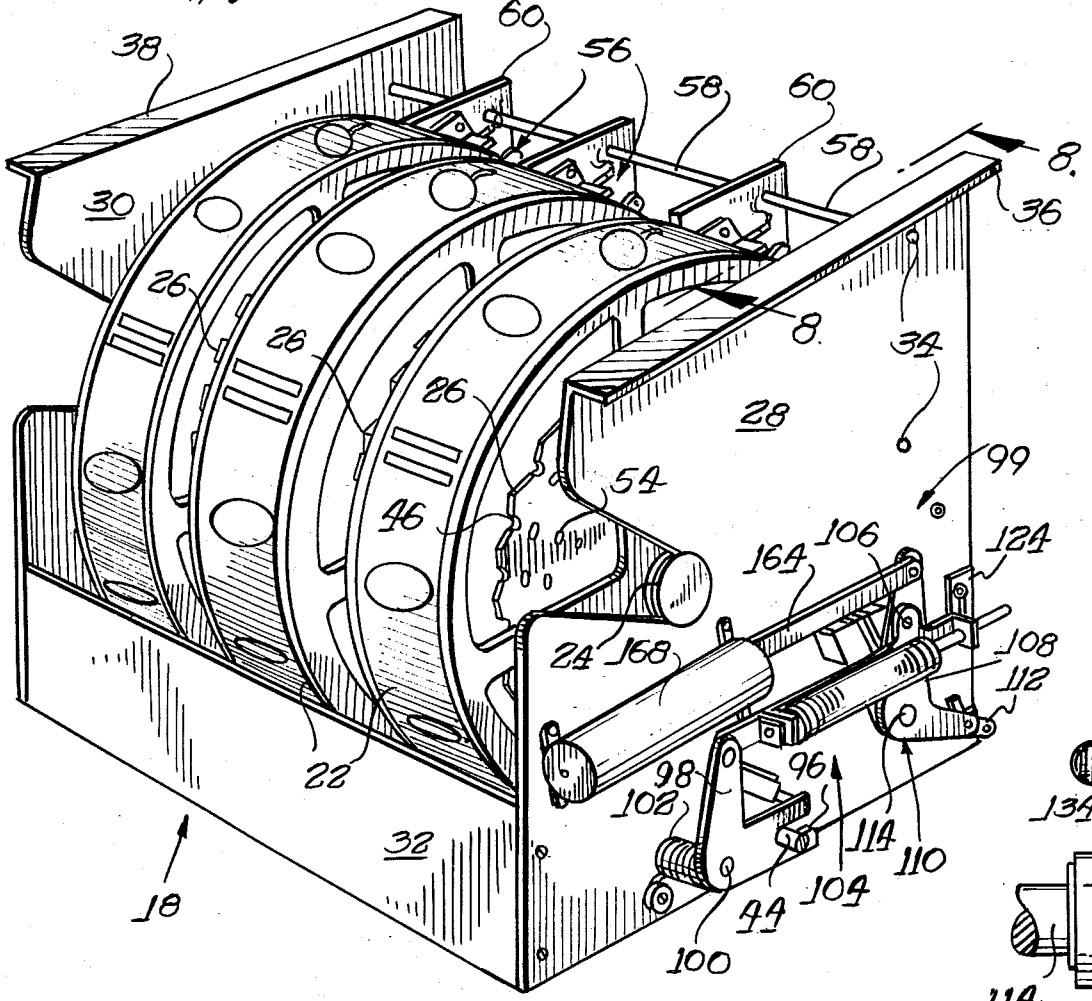
FIG. 4 is an enlarged perspective view of a unitized assembly embodying apparatus of this invention and shown in the device of FIG. 1.
Figures 7, 9:
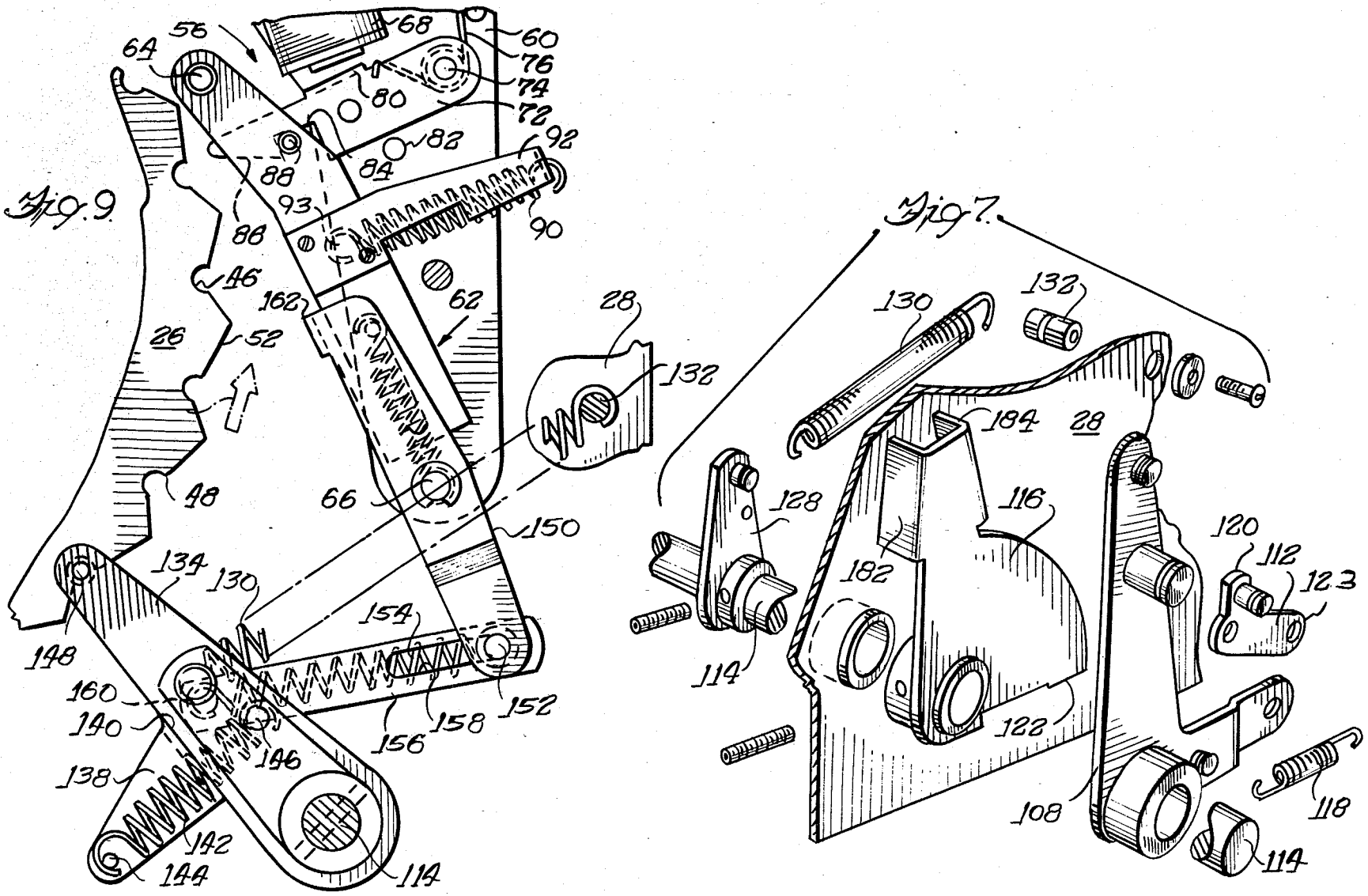
FIG. 7 is an exploded perspective view illustrating trip and drive mechanisms of the apparatus of FIGS. 5 and 6.
Figure 8:
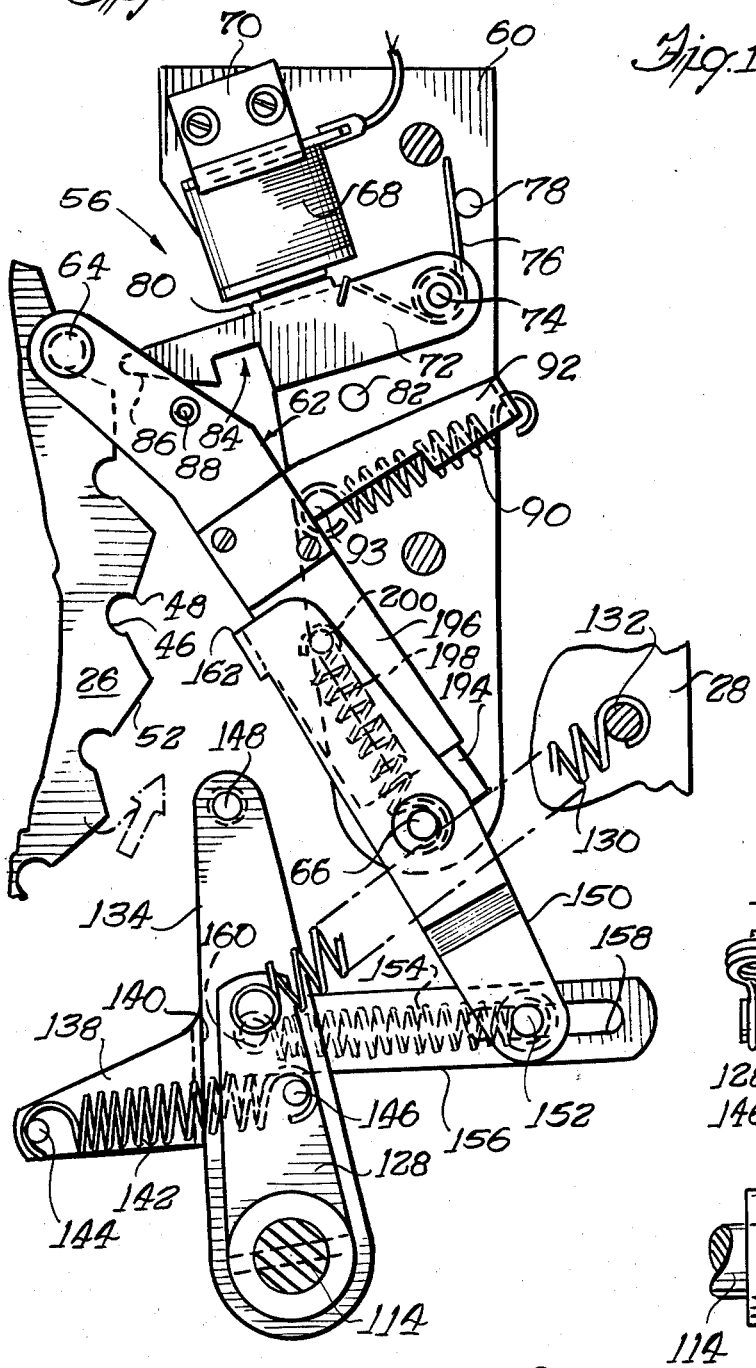
FIG. 8 is a fragmentary sectional view taken along a vertical plane that includes the line 8—8 of FIG. 4 and illustrating the mechanism thereshown generally in the normal or at rest condition.
Figure 10:
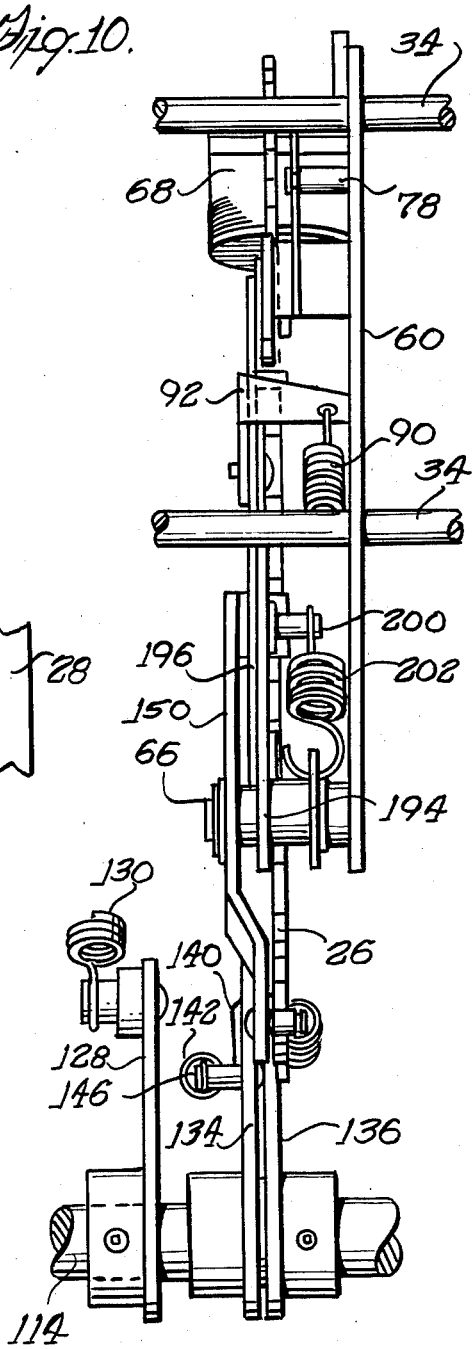
Figure 8A:
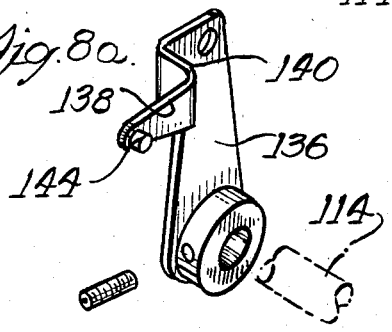

FIG. 8*a* is a perspective view of a crank member useful in the apparatus of FIG. 8;

FIG. 9 is a fragmentary sectional view similar to FIG. 8 except that the mechanism is illustrated generally in the condition just prior to reel spinning;

FIG. 10 is an end view of the mechanism illustrated in FIGS. 8 and 9;

FIG. 11 is a fragmentary rear view of a portion of the assembly of FIG. 4 illustrating the mechanical/electrical interaction of the operating mechanism of this invention; and FIG. 12 is a fragmentary side view of a portion of the mechanism of FIG. 11.

Figure 1:
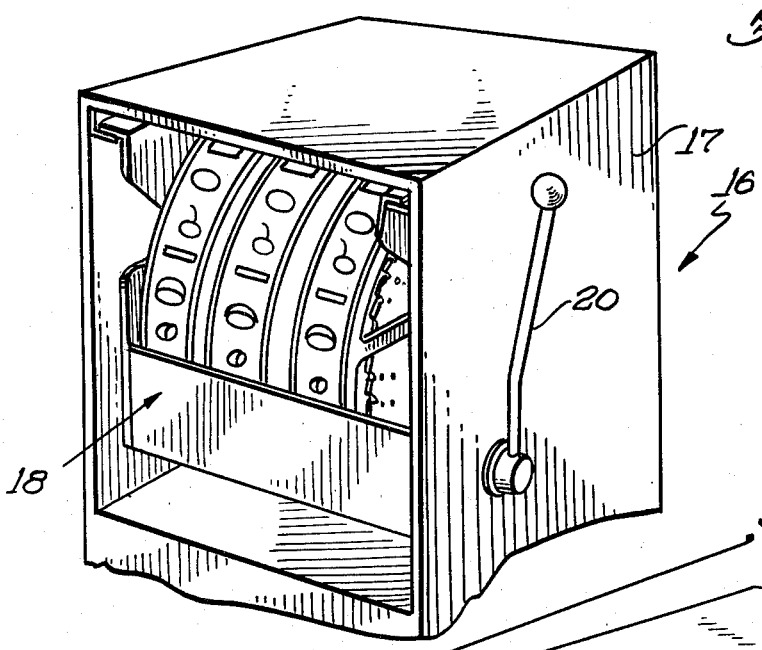
FIG. 1 is a perspective view of a portion of a game device in which release apparatus embodying this invention can be utilized.
Figure 2:
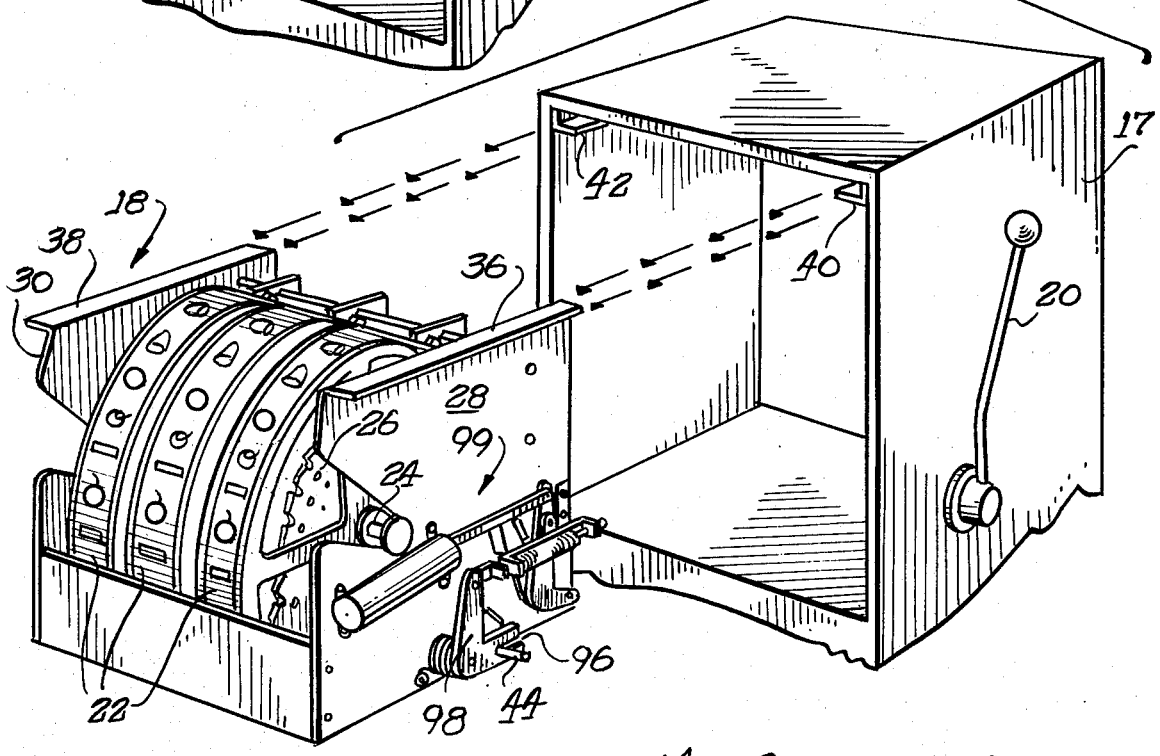
FIG. 2 is a perspective view of the device of FIG. 1 illustrating the removability of a unitized assembly of apparatus embodying this invention.

Referring now to the drawings for a brief description and particularly to FIGS. 1, 2 and 4, there is shown an upper portion of an amusement or game device 16 commonly referred to as a slot machine contained in a cabinet 17, the device including a working internal mechanism carried in a removable unitized assembly 18, the operation of which is initiated by a game handle or lever 20. The assembly 18 includes three reels 22, each of which carries visually observable symbols such as stars, bells or the like along the outer periphery. The reels are rotably mounted on a common shaft 24. Unlike many conventional devices, the reels in the illustrated embodiment are not driven by an electric motor, but rather a player stands in front of the game device 16 and pulls the handle 20 that initiates operation of the device by releasing the reels from their stopped position and setting them in a spinning or rotary motion by spring actuated trip mechanisms that are then arranged to allow free spinning of the reels until they are sequentially stopped or indexed shortly thereafter by timing devices.

A separate flat circular disc 26 is attached to each of the reels 22. The flat circular disc 26 has a plurality of notches along the circumference of the disc that are used for both the initiating movement and the stopping movement, as will be seen in detail hereinafter.

In addition to the function of controlling movement of the reels, the discs may also have a number of apertures therein which are used in conjunction with photoelectric means or other light circuit detecting means to determine winning combinations of the indexed reels.

Figure 3:
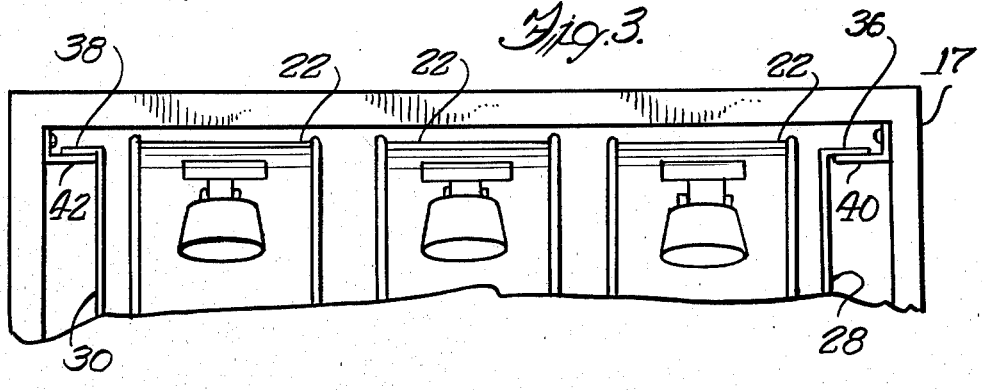
FIG. 3 is a front view of an enlarged fragmentary portion of the device of FIG. 1 illustrating means for mounting the unitized assembly of FIG. 2.

The unitized assembly 18 is shown to have a pair of structural side plates 28 and 30, a front plate 32 and one or more rods or bolts 34, all of which are connected together to form a four-sided support. The upper edges of the side plates 28 and 30 project outwardly to form lips 36 and 38, respectively. As may be seen in FIG. 3, complementing the lips 36 and 38 are a pair of right angle brackets 40 and 42 which provide support in the form of suspension mountings for the assembly 18 while allowing it to slide in and out. The operational mechanism is mounted within this unitized assembly 18 and is slidably engageable with an actuator pin 44 that is an integral part of the hub of the handle 20 on the inside of the cabinet. The pin is spaced apart from the axis of rotation and so moves through an arc when the handle 20 is pulled. Any electrical wiring of the parts that extends between the cabinet 17 and the unitized assembly 18 is made long enough to permit the assembly to be withdrawn from the cabinet and set on a table or bench adjacent the cabinet for complete accessibility to the unitized assembly as well as the inner parts of the cabinet 17.

In accordance with this invention, a player initiates operation by pulling the handle 20. The mechanism of the invention begins a gradual retraction of the stopping apparatus that has held the reels in position since the last play. Along with this retraction, the handle pull also initiates a gradual engaging movement of drive apparatus that will first of all set the reels in a reverse rotational movement of a few degrees just prior to suddenly setting them into full operational spin in their normal direction (counterclockwise in the drawings). Means are provided to prevent a "yank" on the handle from causing a premature release of the trip mechanism. Although the speed of the initial reverse rotation of a few degrees of the reels is related to the operator's speed of pull on the handle, the spring actuated spin of the reels is substantially independent of the speed of movement of the operating handle.

Once the reels are set in their full spinning motion, they continue to rotate freely because of being mounted on the shaft 24 by means of roller bearings (not shown). The normal direction of rotation of the reels as viewed in the drawings is counterclockwise. This rotation continues until the reels are randomly arrested (indexed) by suitable electrical or mechanical timing means.

Figure 5:
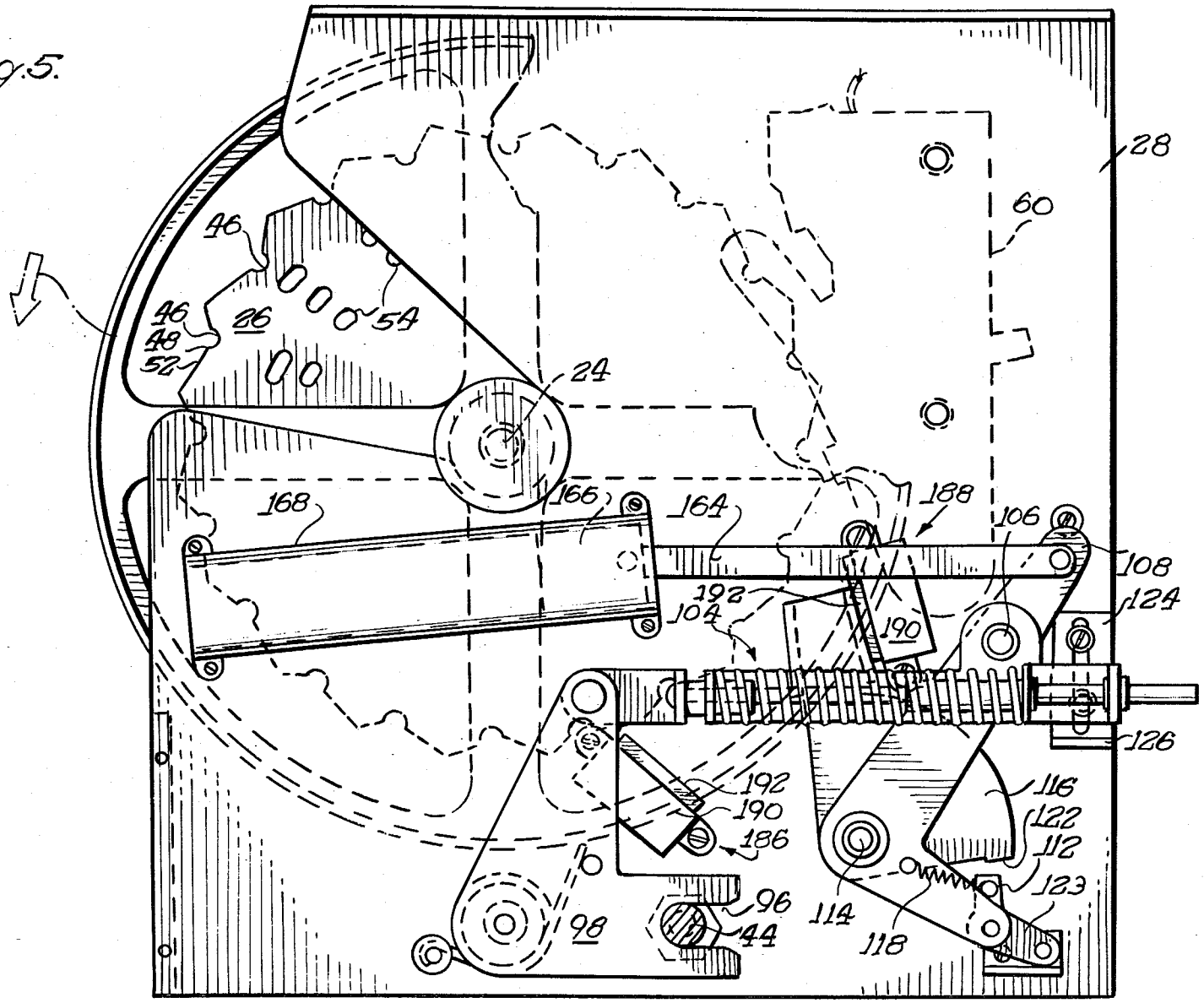
FIG. 5 is a side view of the assembly of FIG. 4 illustrating the mechanism thereshown generally in the normal or at rest condition.

Referring now more particularly to the apparatus of the invention and with initial reference to FIGS. 4 and 5, it should be understood that although the illustrated embodiment shows three reels 22 contained in the assembly 18, this is shown for purposes of illustration only. There is no intention to limit the invention to a playing device having a specific number of reels, nor must the reels be of a specific width or diameter. As indicated previously, there is a separate flat circular disc 26 for each of the reels 22, irrespective of the number and size of reels used in the game device 16. Each disc 26 has a plurality of notches 46 that are preferably equally spaced along the circumference of the disc, the number of notches preferably corresponding to the number of individual symbols that are located on the peripheral surface of the reels 22. With disc 26 rotating in the counterclockwise direction as shown by the arrows in FIGS. 5–6 and 8–9, the front or leading edge 48 (relative to the direction of disc rotation) of the notch 46 terminates at a point that is radially inwardly spaced relative to the outermost circumference of the disc. A slanted surface or ramp 52 extends from the edge 48 of the notch outwardly to the outer circumference of the disc 26. This ramp 52 serves as an approach surface for the stopping mechanism, to be described hereinafter, as it moves into engagement with the notch 46. It will also be noted in accordance with this structure that the entire notch 46 is recessed relative to outermost circumference of the disc 26.

Each disc 26 is also shown to have a number of apertures 54 which are used by the light decoding circuitry previously mentioned, and these apertures may be relatively small, e.g., about one-eighth inch in diameter. The apertures are provided in radial rows that extend inwardly from each notch toward the axis in one direction and on a plurality of concentric circles in another direction. Each notch position has an appropriate number of apertures in the rows to provide the essential bits of binary information which can be used to detect the winning combinations.

As mentioned, previously, reels set spinning during play are sequentially stopped by suitable electrical and mechanical means, such as index means 56, best illustrated as to location in FIG. 4 and best illustrated as to detail in FIG. 8. Referring first to FIG. 4, a plurality of such index means 56 are shown being mounted between the side plates 28 and 30 by the pair of rods or elongated bolts 34 that extend between the side plates. Appropriate spacing is determined by suitable sleeves 58 that extend between adjacent index means 56 and/or the appropriate side plate. Each index means 56 is mounted on a stationary support plate 60 having suitable apertures therein through which the bolts 34 are passed. The apertures are, of course, of smaller diameter than the positioning sleeves 58.

Referring now to FIG. 8, each means 56 comprises an index arm assembly 62 having a stop member 64 at one end portion thereof and an attachment means, indicated generally at 66, at the other end portion. The index arm assembly is pivotal around the attachment means 66 so that the stop member 64 can be moved into and out of engagement with one of the notches 46 during operation.

The support plate 60 is utilized for mounting the components of the index means 56. A trip coil 68 is mounted near the left top (as viewed in FIG. 8) of the support plate 60 by means of a bracket 70 and appropriate mounting screws. A latch link assembly 72 is mounted pivotally at 74 on the support plate 60 and along with the trip coil 68 combines to form a latch relay. A torsion spring 76 is wound around the mounting 74 and extends between a post 78 and the latch link 72. The latch link assembly contains a right angle extension 80 which is located along the edge near the trip coil 68 to form an armature of the latch link assembly that is attracted to the coil 68 when the coil is energized, and which is biased away from the coil 68 by the spring 76 when the coil is deenergized. A post 82 limits the movement of the latch assembly 72 away from the coil. This post can be mounted for adjustment of position if desired. A notch 84 is provided near the distal end of the latch link assembly 72 and a slanted ramp or follower surface 86 extends outwardly from the notch 84 to a blunt nose of the latch link assembly 72.

In FIG. 9, the notch 84 is shown engaging a latch pin 88 of the index arm assembly 62 and holding the arm assembly out of engagement with the flat circular disc 26 and outwardly of the outermost circumference of the disc. Once the reels are in their spinning motion, this position of the index arm allows the continued spinning of the reels until indexing occurs. The latch pin 88 serves as a cam for pushing the distal end of the latch link assembly 72 upwardly as viewed in FIG. 9 against the urging of the spring 76 until the pin 88 is engaged in the notch 84 when the index arm assembly 62 is retracted from the disc 26, as will be seen hereinafter.

Returning to FIG. 8, when the trip coil 68 is energized and pulls the armature or latch link 72 upwardly, the latch pin 88 is released and the index arm assembly 62 is urged toward the disc 26 by a spring 90 (in tension in the condition shown in FIG. 9). The spring 90 attaches to the index arm assembly 62 by means of a suitably attached bracket 92 whose distal end extends substantially at right angles to the index arm outwardly in a direction away from the disc 26. The other end of the spring 90 is connected to a post 93 spaced away from the distal end of the bracket in a direction toward the disc in the support plate 60. Thus, the biasing of the spring 90 moves the index arm toward the disc 26 so that the stop member 64 can engage an approaching notch 46 to stop (index) a rotating reel.

This position of engaging and holding the disc 26 as viewed in FIG. 8 is the normal or idle condition of the apparatus between plays, except for the latch link 72. Generally only a pulse energizes the coil 68, following which the coil is deenergized and the latch 72 under spring tension is pulled away from the coil.

Turning attention once again to FIGS. 2 and 4, a player standing in front of the game device 16 initiates play by pulling the lever or handle 20 toward the front of the cabinet. As mentioned previously, an actuator pin 44 is mounted in the hub of the handle 20 but is spaced apart from the axis of rotation. Thus, as the handle 20 is moved to the front of the cabinet, the pin 44 moves through an arc of rotation.

A hard rubber stop (not shown) is provided on the inside of the cabinet 17 to limit the movement of the handle 20 when pulled by the player. This stop is located to permit, of course, full operational movement of the mechanism to be described hereafter. A full stroke pawl and spring return (not shown) are also provided on the inside of the cabinet 17 to work in conjunction with the hand movement of the handle 20.

The arcuate movement of the pin 44 operates reel actuator apparatus generally referred to as 99 and generally mounted on the side plate 28. The actuator pin 44 is received in a slot 96 of an actuator plate 98 in the form of a bell crank having its fulcrum as a pivotal mounting at its apex on a post 100 against the urging of a torsion spring 102. The torsion spring, when permitted, returns the plate 98 to normal. Pivotally attached to the other end of the actuator plate 98 is a drive link and assembly 104, which in turn is pivotally connected at 106 to a trip drive lever arm assembly 108, which has a trip pawl 112 pivotally mounted on one of its ends. The lever arm assembly 108 is pivotally mounted on a trip shaft 114 that in turn is rotatably mounted in and extends beyond the outside of side plates 28 and 30.

As is best seen in FIG. 7, the trip drive lever arm assembly 108 is spaced outwardly from the side plate 28, and a trip lever 116 is mounted on the trip shaft 114 between the side plate 28 and the lever arm assembly 108. Unlike the trip drive lever arm assembly 108, however, the trip lever 116 is secured to the shaft 114, as by a key or pin, so as to rotate therewith. The lever 108 is pivotally mounted on the shaft 114, and the pawl 112 is pivotally mounted at the outer end of the lower arm of the lever 108 and is held in the position shown by a spring 118.

As best seen in FIGS. 5 and 7, on the upper extension of the trip pawl 112 is a surface 120 having slightly rounded edges. This surface 120 aligns with and is below an outer portion of the trip lever 116. A surface 122 is provided at the lower outer portion of the trip lever 116, and when the lever arm 108 is rotated in a counterclockwise direction about the shaft 114, the pawl surface 120 contacts the trip lever surface 122 and causes the trip lever to rotate the shaft 114 in a counterclockwise direction. Such movement continues as long as the two surfaces 120 and 122 are in contact with each other.

Such counterclockwise rotation of the trip drive lever arm 108 is brought about by the player pulling the handle 20 (FIG. 2) in initiating game action. It has already been mentioned that when this occurs, the actuator pin 44 riding in the slot 96 rotates counterclockwise through an arc and causes the actuator plate 98 to rotate about the post 100 which pulls the drive link and spring assembly 104 generally to the left as indicated by the arrow in FIG. 6. Because this assembly 104 is pivotally connected to the upper arm of the lever arm 108 at 106, the lever arm 108 is caused to rotate in its counterclockwise direction around the shaft 114 and rotate the trip lever 116 and trip shaft 114.

Figure 6:
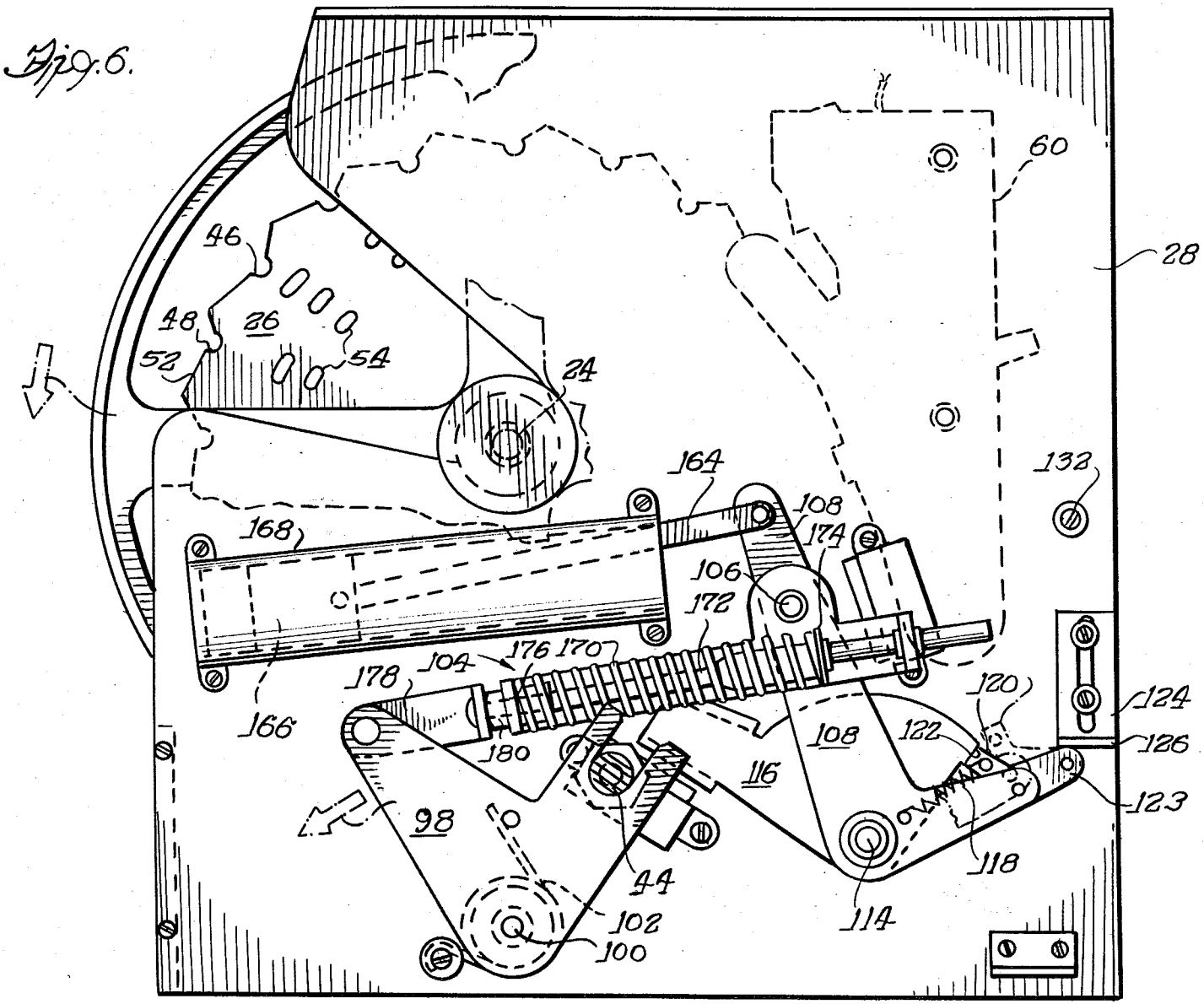
FIG. 6 is a side view similar to FIG. 5 except illustrating the mechanism generally in a condition just prior to reel spinning.

An adjustable stop bracket 124 having a lower right angle extension 126 is located on the end plate 28 to intercept an outer extension 123 of the trip pawl 112 in the position shown in solid lines in FIG. 6. As the counterclockwise rotation of the lever arm 108 continues, the extension 126 of the stop bracket forces a clockwise rotation of the trip pawl 112 about its pivot point and against the urging of the pawl spring 118 into a position shown in dashed lines in FIG. 6. At this point, the surface 120 is rotated free of its previous contact with the surface 122 of the trip lever 116.

At the same time the shaft 114 was being rotated by the trip lever 116 in a counterclockwise direction, and a kick spring arm 128 (FIG. 7) mounted on and also keyed or pinned to the shaft 114, was being rotated counterclockwise against the tension of a kick spring 130 hooked over a post at the distal end thereof. The other end of the spring 130 is hooked over a stationary post 132 mounted on the side plate 28 and spaced away from the arm 128 in a direction opposite the disc 26. Thus, the spring 130 is in an extended condition by the time the pawl 112 is rotated out from under the trip lever 116. At the moment the pawl 112 clears the lever 116, the spring 130 snaps back to recover its original shape upon such release and in doing so provides power through the arm 128 to cause a sudden but partial clockwise rotation of the shaft 114. It is this action, as will be seen hereinafter, that sends the reels 22 into their full spinning motion in their normal or given counterclockwise direction.

Reference is now made to FIGS. 8 and 9 for a description of how the player initiated action just described acts through the mechanism to release the reels from their indexed position and send them into full spinning motion while the mechanism maintains control of the reels until released when sent into their full spinning motion. It will be remembered that the view in FIG. 8 illustrates the indexed condition of the reels, which condition is also that which exists just prior to a player initiating play action.

It should be mentioned at this point that for proper functioning of the game device, it is desirable for the apparatus to maintain control over the reels at all times that they are not released in full spinning motion. Thus, if the stop member 64 is to be pulled away from a notch in the disc 26 to free the disc for rotation, it is important that the reels not be permitted to notch to a new symbol display after the removal of the stop member 64 from engagement with the disc and before the release and spin condition is ready. This is accomplished in the illustrated embodiment in the manner described hereinafter.

In FIG. 8, the stop member 64 is shown engaging a notch 46 and thereby holding the disc 26 in position. As the player initiates play action by pulling the handle 20 (FIG. 1), rotation of trip shaft 114 occurs in a counterclockwise direction as already described against the urging of the kick spring 130. A drive lever 134 is also mounted on the trip shaft 114 as may be seen in the lower portions of FIGS. 8 and 10. This drive lever, however, is not keyed to the shaft 114 and is therefore rotatably independent of the shaft. A crank arm 136, shown in FIG. 8*a*, is mounted on the trip shaft 114 immediately adjacent the drive lever 134 as may be seen in FIG. 10. This crank arm 136 is keyed or pinned to the trip shaft 114 so that it rotates therewith. At the upper end of the crank arm 136 is a spring arm extension 138 joined to the upper or distal end of the crank arm. This extension 138 is offset from the crank arm proper, however, by a shoulder 140. It is this crank arm 136 that is instrumental in moving the drive lever 134.

When the trip shaft 114 is rotated in a counterclockwise direction, the crank arm 136 also rotates in a counterclockwise direction and pulls the drive lever 134 in a counterclockwise direction with it by a suitable flexible means, such as a spring 142. The spring 142 is connected at its one end to a pin 144 on the spring arm extension 138 and at its other end to a pin 146 on the drive lever 134. The counterclockwise movement of the drive lever 134 continues until a drive pin 148 at its upper or distal end fully engages a notch 46 in the flat circular disc 26 as shown in FIG. 9. At this point, there is permitted some continued movement of a few degrees in the counterclockwise direction of the drive lever 134 which causes a corresponding movement in the clockwise direction of the disc 26 and the reel 22 to which the disc is attached. The reel is free to follow the movement of the drive pin 148 at this point because the stop member 64 which had been holding the disc in position has since been moved out of engagement with the circular disc 26 by the same rotational movement of the trip shaft 114 that caused the engagement of the drive lever 134 and drive pin 148 with the disc 126, as will now be described.

This common movement of the shaft that causes disengagement of the stop member 64 from the disc 26 is best described with reference to FIGS. 8 and 9. In the lower portion of both these figures, it will be noted that an index arm retraction lever 150 is pivotally mounted by the attachment means 66 at the lower end of the stationary support plate 60 along with the index arm assembly 62. The index arm retraction lever is mounted for rotation at its approximate midpoint. It has an upper portion that extends parallel to and adjacent the index arm assembly 62 and a lower portion that extends parallel to the index arm and beyond the mounting end of the index arm. At its lower end is a pin 152 to which one end of a spring 154 is connected. The pin extends through and is slidably engaged with a link 156 at one of its ends by means of a slot 158 provided in the link. The other ends of the spring 154 and the link 156 are joined to the upper end of the crank arm 136 on a pin 160 in an appropriate aperture. Thus, when the crank arm 136 is moved in a counterclockwise rotation, it pulls the link and spring with it which in turn pulls the lower end of the index arm lever 150 to the left as viewed in FIGS. 8 and 9. The upper end, of course, is moved to the right as viewed in these figures. At the upper end of the index arm retraction lever 150 is a right angle extension 162 which moves against and contacts the edge of the index arm assembly 62 nearest the disc 26 and carries with it the index arm assembly 62. The index arm assembly 62 then pivots about its mounting point at the attaching means 66, whereby the upper portion moves clockwise or to the right as viewed in these figures. The latch pin 88 slidably engages the ramp 86 of the latch link assembly 72, whereby a cam and follower action occurs between the latch pin and the ramp. This moves the latch link upwardly as the pin continues its movement to the right until the latch 72 is biased by the spring 76 to hook the notch 84 over the pin 88. Continued movement would cause the pin 88 to eventually strike the opposite end of the notch 84, a physical limit to movement of the index arm assembly 62.

The link 156 with the slot 158, spring 154 and pin 152 relationship avoids stress on the parts when and if such a limit is reached. This slot and spring arrangement allows override of the trip shaft 114 rotation just prior to the trip action without causing undue stress on this mechanism chain.

Thus, the link 156 interconnects the stop member retracting lever and the crank arm which moves the drive lever and is arranged to not pull the stop member 64 outside the confinements of the notch 46 of the circular disc 26 with which it is engaged until the drive pin 148 is moved in position to seat with another notch 46. Hence, the reel 22 and the disc 26 are not free to rotate beyond the small limits allowed by the members 64 and 148 in the notches 46 during the simultaneous transfer of engagement of the disc from the stop member 64 to the drive member 148.

Returning to the initial pull of the handle 20 which a player makes on initiating play action, as the trip shaft 114 is rotated in the counterclockwise direction while the player is pulling the handle, it will be remembered that the counterclockwise rotation continues until the trip pawl 112 (FIGS. 5 and 6) engages the right angle extension 126 to rotate the surface 120 out from under the surface 122 of the trip lever 116. By this time, the drive pin 148 has fully engaged a notch 46 (FIG. 9) and the stop member 64 has cleared the outer circumference of the disc, transferring the control of the disc 26 to the drive pin 148. Thus, when the drive pin 148 fully engages the notch, the disc 26 is free to rotate a few degrees in its reverse (clockwise) direction with the continued movement of the drive lever 134. It is at this point that the player obtains his feeling of participation in the game process as the reels 22 respond in rotational movement coincidental with the continued arcuate motion of the handle 20 under the control of the player. The reels, of course, are under control of the drive lever at this time. A slow movement of the handle will result in a slow, deliberate responsive rotation of the reels, whereas a faster movement of the handle will respond in a correspondingly faster responsive movement of the reels.

In this connection, and referring to FIGS. 5, 6 and 9, inertial resistance of the drive lever 134 resulting from a fast yank on the handle 20 could allow rotation of the shaft 114 and crank arm 136 ahead of the drive lever 134 by expansion of the spring 142. This inertial lag could then allow the tripping of the system before the drive member 148 has achieved seated engagement with a notch 46, and tripping when the drive member only partially engages a notch might impede the reel spin since the drive member would then disengage its partial engagement before transferring full rotative energy to the reel. Accordingly, a damping system is provided to place an upper limit on the speed of rotation of the parts that sufficiently diminishes the inertial lag on the drive lever 134 to assure seated engagement of the drive member 148 with a notch 46 before spin is imparted to the reels. In this connection, the upper end of the lever arm 108 is pivotally connected by means of a link 164 to a piston 166 which acts within a cylinder 168 to form a convenient dashpot. A controlled bleeding port (not shown) in the dashpot is provided in a conventional manner to control the cushioning or damping action by, in this instance, the piston compressing air in the cylinder. In addition, the drive link and spring assembly 104 allows temporary storage of energy in the event the energy in the pull on the handle 20, such as a yank, exceeds the energy absorbed by the resistance of the dashpot. This assembly 104 includes an elastic means, such as a compression spring 170 acted upon by a connecting rod 172 and a disc cap 174 attached to the connecting rod. The rod 172 is carried by an elongated u-shaped bracket 176 through appropriate bushings. The rod is connected at one end to a right angle extension of a link 178 that in turn is pivotally connected to the actuator plate 98. A spacer 180 separates the link 178 and the bracket 176, and the space between these two parts will increase against the compression of the spring 170 (link separating from the bracket) when continued force on the actuator plate 98 exceeds the resistance on the system of parts because of compression of air in the dashpot caused by a yank.

The spring 142, in addition to pulling the drive lever 134, acts to protect the system against shock and damage should a parts jam occur and undue forces are applied to the parts through the mechanical advantage of the operating handle 20.

The reels 22 are set in full spinning motion in accordance with the following sequence of events utilizing the following described mechanisms.

Referring first to FIG. 7, the trip lever 116 as thereshown has at its upper end a pair of ears 182 and 184 formed at right angles to the general plane of the lever. It will be noted that the two ears are not parallel to each other. With reference now to FIG. 5, there are a pair of cushioned stops 186 and 188 located at the approximate ends of the arc through which the trip lever 116 traverses in its operation. Each of the cushioned stops includes a holder 190 that is secured to the side plate 28 by suitable means, such as screws, and a block of resilient material 192, such as hard rubber, that is contained within each holder 190. Preferably, the holders are made of metal and the block of resilent material is sized to protrude outwardly from each holder to present a face of the resilent material as a compact surface for the ears 182 and 184 respectively. For the shaft 114 to rotate through the number of degrees necessary to accomplish the machanical function of the mechanism herein described, the trip lever 116 will travel through an arc having terminations at the approximate location of the cushioned stops 186 and 188 shown in FIG. 5. Such an arc is less than a full circle and is preferably around 45°. The particular angles of the cushioned stops are selected so as to be parallel with the associated ears 182 and 184 when the trip lever is at the corresponding end of its operating arc.

Thus, when the trip pawl 112 is rotated free of the surface 122 as indicated in FIG. 6, the kick spring 130 (FIGS. 7 and 9) in its then extended condition is allowed to recover its original condition and in doing so pull with it the kick spring arm 128 which, being keyed to the shaft 114, rotates the shaft in a clockwise direction. This, of course, occurs suddenly when the spring snaps back to its pre-deformed condition. The rotation of the shaft continues until the ear 184 comes in contact with the block of resilent material 192 of the upper cushioned stop 188. This action occurs independently of the position of the actuator plate 98 and the lever arm assembly 108 in FIG. 6, and the player may not have yet released the handle 20 by the time the trip shaft 114 is returned to its normal position. The trip drive lever arm 108 is not keyed or pinned to the shaft 114, and so the shaft 114 can rotate independently of the position of this lever arm.

At the onset of the trip action just described, the drive pin 148 is engaged with a notch 46 in the disc 26 as indicated in FIG. 9. Thus, as the spring 130 snaps the trip shaft 114 into a sudden rotation in the clockwise direction, all parts keyed or pinned to the shaft 114 rotate therewith. Although the drive lever 134 which carries the drive pin 148 is freely rotatable on the shaft 114, the crank arm 136 (FIG. 8*a*), which through the spring 142 had pulled the drive lever 134 and the drive pin 148 into contact with the slot 46, now is responsible for a sudden reverse rotation of the drive lever 134. This occurs by the shoulder 140 of the crank arm acting against the edge of the drive lever 134 nearest the disc and carrying the drive lever with it as it is rotated by the shaft 114. The drive pin 148 being fully engaged with the notch 46 rotates the disc 26 until the arcs of travel of the pin 148 and the notch 46 separate, bringing about disengagement of these two parts. The snap action while fully engaged, however, imparts a full spinning motion to the reel in the counterclockwise direction, which motion continues until the reel is indexed.

Each of the reels 22 is rotatably mounted on the reel shaft 24 by means of roller bearings, and once the reels are set in motion, they are free to continue their motion with little frictional resistance.

The freely rotating reels continue until on electronic control circuit (not shown) sends pulses to the various index means 56 to energize the respective coils 68 to release the index arms 62 which, by spring urging as previously described, separately causes each stop member 64 to engage a notch 46 to sequentially bring the rotating reels to a stop. Generally the reels are indexed to stop sequentially from left to right. The timing, which may be controlled by a microprocessor to provide pulses in a random manner to the respective electromagnetic coils, may vary between the indexing of adjacent reels. When the stop member has initially engaged a notch as is shown in FIG. 8, the disc will be stopped, but the angular momentum of the disc and reel will apply a force in the direction of the arrow which, due to the construction of the indexing apparatus of this invention, will result in the index arm assembly 62 being extended, i.e., the stop member 64 will be carried a small distance during the stopping action, and this is achieved because of the extendability of the index arm assembly 62 relative to the support plate 60.

In this connection, it is noted that the specific embodiment has an index arm assembly that is resiliently extendable to bring about a cushioning effect in the stopping of the reel. To permit this cushioning effect and referring to FIGS. 8 and 10, the index arm assembly 62 is shown to include a first elongated plate member 194 which is attached to the support plate 60 by the attachment means 66 and a second elongated member 196 which carries the stop member 64. The members 194 and 196 are connected to one another in a manner which permits limited sliding movement in the direction of their length. This is accomplished by the member 194 having an elongated slot 198 in which a pin 200 passes and which is suitably attached to the arm member 196. The pin 200 extends through the slot 198 and receives one end of a spring 202 (FIG. 10) that is tensioned to bias the arm member 196 toward the attachment means 66. The other end of the spring 202 is hooked onto a suitable retainer means on the attachment means 66. When the stop member 64 has moved into engagement with one of the notches and the angular momentum of the disc moves the index arm assembly 62 to its extended position, the pin 200 extends the spring 202. After the disc has been stopped, the biasing force of the spring 202 will move the arm member 196 back to its unextended position. The cushioning effect produced by the apparatus significantly lessens the wear that is occasioned on the notches. Consequently, mild steel or non-case hardened steel may be used for the disc, and this reduces initial manufacturing costs. The electronic circuitry which controls the timing of the spinning reels is not shown or described herein in order to simplify the description of this invention. It should be understood, however, that appropriate electronic means is provided as a part of the operational embodiment, although it is not a part of this particular invention. With reference now to FIGS. 11 and 12, the start of the electronic timing is signaled by a timing cam 204 which is mounted on the far end of the trip shaft 114 on the outside of the structural side plate 30 as shown in FIG. 11. The timing cam 204 is appropriately keyed or pinned to the trip shaft 114 to rotate therewith. Mounted in surrounding relation to the timing cam 204 are a pair of appropriate switching devices, such as microswitches 206 and 208 as seen in FIG. 12. The timing cam is appropriately positioned on the shaft to operate the switches in accordance with the rotation of the shaft 114 as related to the trip release of the reels. The various starting and reset functions are thus initiated by this timing cam.

In accordance with this invention, there has been provided a reel spin mechanism for use in an amusement or game device which includes a reel mounted for rotation, and a circular disc with a plurality of notches located along the circumference is attached to the reel. The notches are formed to receive a drive member for imparting spin to the disc and reel. The mechanism includes a shaft mounted for rotation and extending parallel to the axis of the reel. Pivotally mounted on the shaft for independent rotation is drive lever means having a drive member at the distal end for engagement with one of the notches when the drive lever is pivoted toward the disc. A means is connected to the shaft for pivoting the drive lever means toward and away from the disc, the pivoting means causing the drive member to fully engage a notch in the reel after pivoting the drive lever means toward the disc at the initiation of play and thereafter effecting a few degrees rotation of the disc and reel in a first direction of rotation. Further included is means for imparting spin to the disc and reel in a direction opposite the first direction of rotation.

From the foregoing it should be appreciated that an improved apparatus for releasing and spinning rotating reels that may be used in game devices such as slot machines or the like has been shown and described which offers significant advantages in terms of player attraction, simplicity of mechanism, extended useful life, and unitized construction for ease of conversion of existing game devices. Although particular embodiments of this invention have been illustrated and described, various modifications, substitutions and alternatives will be apparent to those skilled in the art, and accordingly, the scope of the invention should be defined by the appended claims and equivalent thereof.

Various features of the invention are set forth in the following claims.

What is claimed is:

1. Reel spin mechanism for use in an amusement or game device, comprising a reel mounted for rotation;

a circular disc with a plurality of notches located along the circumference thereof attached to said reel, the notches being formed to receive a drive member for imparting spin to the disc and reel;

a shaft mounted for rotation and extending parallel to the axis of the reel;

drive lever means pivotally mounted for independent rotation on said shaft and having a drive member at the distal end thereof for engagement with one of the notches when said drive lever means is pivoted toward the disc;

means connected to said shaft for pivoting said drive lever means toward and away from the disc, said pivoting means causing said drive member to fully engage any notch in said reel after pivoting said drive lever means toward the disc at the initiation of play and thereafter effecting a few degrees rotation of the disc and reel in a first direction of rotation; and means for imparting spin to the disc and reel in a direction opposite said first direction of rotation, said spin means including a member connected to said shaft to rotate therewith.

2. The mechanism in accordance with claim 1 further comprising index arm means for stopping and releasably holding the rotative position of the disc and reel, said index arm means being pivotally mounted on a stationary support and having a stop member at its distal end formed to be received by the notches of the disc;

means connected to the stationary support for randomly indexing the disc and reel by causing the stop member to engage any one of the notches and stop rotation of the disc and reel;

means connected to the stationary support for retracting the stop member from engagement with the indexed notch;

means interconnecting said drive lever pivoting means and said stop member retracting means for coordinating the pivoting of said drive lever means toward the disc for engagement thereof by the drive member with the retraction of the stop member from engagement with the disc to cause the drive member to be in position to seat in engagement with another notch before the stop member is retracted from the indexed notch; and means for permitting free rotation of the disc and reel when the drive member is thereafter moved out of engagement with the disc as the reel is set in motion.

3. Apparatus for spinning and indexing a rotatable reel of the type used in an amusement or game device, comprising: a reel mounted for rotation;

a circular disc attached to said reel and having a plurality of notches located along the circumference of the disc, the notches being formed to receive a stop member for stopping rotation of and releasably holding the rotative position of the disc and reel and a drive member for imparting spin to the disc and reel;

an elongated index arm means having attachment means at one end pivotally attaching said index arm means to a stationary support and having a stop member at the other end thereof for random engagement with any one of the notches when said index arm means is pivoted toward the disc;

means connected to the stationary support for retracting the stop member from engagement with the indexed notch;

a shaft mounted for rotation and extending parallel to the axis of the reel and disc;

drive lever means pivotally mounted for independent rotation on said shaft and having a drive member at the distal end thereof for engagement with a notch when said drive lever means is pivoted toward the disc;

means connected to said shaft for pivoting said drive lever means toward and away from the disc;

means coordinating the pivoting of said drive lever means toward the disc for engagement thereof by the drive member with the retraction of the stop member from engagement with the disc to cause the drive member to be ready to seat in a notch before the stop member is disengaged from the indexed notch, whereby the disc and reel are not free to rotate during the transfer from engagement of the disc by the stop member to engagement of the disc by the drive member;

means for permitting free rotation of the disc and reel when the drive member is thereafter moved out of engagement with the disc;

means for imparting spin to the disc and reel, said spin means including a member connected to said shaft to rotate therewith; and means for randomly indexing the disc and reel by causing the stop member to engage one of the notches after the disc and reel are in full spinning motion.

4. Apparatus in accordance with claim 3 wherein said index arm means includes means for cushioning the impact of said stop member when it is moved into engagement with one of the notches as the disc and reel are rotating, said index arm means permitting said stop member to be resiliently movable with the notch during stopping for a predetermined amount of arcuate movement of the disc.

5. Apparatus in accordance with claim 3 wherein said coordinating means includes an interconnecting member that joins said stop member retracting means and said drive lever pivoting means.

6. Apparatus in accordance with claim 5 wherein said means for retracting the stop member from engagement with one of the notches includes means for engaging the stop member with a notch, which means include an elongated bracket mounted on said index arm means and extending generally at right angles thereto in a direction away from the disc, a spring having one end connected to the distal end of said bracket and its other end connected to the stationary support at a location spaced away from the distal end of said bracket in a direction toward the disc, whereby the spring urges said stop member toward the disc, and a retraction lever means pivotally mounted at its midportion to the stationary support at the same location as the pivotal mounting of said elongated index arm means, one portion of said retraction lever means extending parallel to and adjacent said index arm means and another portion thereof extending parallel to said index arm means and beyond the mounting end, the portion of said retraction lever means adjacent said index arm means having a right angle extension that contacts the edge of said index arm means nearest the disc when that portion of the lever rotates away from the disc, and the portion of said retraction lever means extending beyond the pivotal mounting being connected to said interconnecting member for rotating that extension portion of the retraction lever in a direction toward the disc and thereby move said stop member out of engagement with the notch in the disc.

7. Apparatus in accordance with claim 5 wherein said means for pivoting said drive lever means toward and away from the disc includes a crank arm connected to said shaft to rotate therewith and having a right angle extension at its distal end extending in a direction toward the disc, a spring having one of its ends connected to the end of the outer extension and the other of its ends connected to said drive lever means, whereby when said crank arm rotates in a direction toward the disc, said drive lever means is moved toward the disc, and said crank arm further including a shoulder adjacent the edge of said drive lever means facing the disc that contacts the edge and pivots said drive lever means away from the disc when said crank arm is rotated in a direction away from the disc.

8. Apparatus in accordance with claim 7 wherein said interconnecting member includes a link having one of its ends connected to said crank arm and the other of its ends having an elongated slot therein and receiving a pin therethrough from the extended end portion of said retracting lever means and a spring with one end connected at the mounting point of said link and its other end connected to the pin extending through the slot in the outer end of said link.

9. Apparatus in accordance with claim 3 wherein said means for permitting free rotation of the disc and reel includes latch means for releasably holding said stop means outside the outermost circumference of the disc after said stop means reaches such location following disengagement with the disc.

10. Apparatus in accordance with claim 9 wherein said means for randomly indexing the disc and reel includes electromagnet means associated with said latch means so as to cause said latch means to release said stop means when said electromagnet magnet means is energized and spring means biasing said index arm means toward said disc whereby said stop member engages the first of the notches.

11. Apparatus in accordance with claim 3 wherein said means for imparting spin to the disc and reel includes a kick arm connected to said shaft so as to rotate therewith;

a kick spring having one of its ends connected to the distal end of said kick arm and the other of its ends connected to stationary means at a location spaced in a direction away from the disc, whereby when said shaft rotates said kick arm in a direction toward the disc, the spring expands;

trip lever means connected to said shaft so as to rotate said shaft when said trip lever means is rotated; and means for rotating said trip lever means and said shaft to a predetermined point and in a direction expanding said kick spring and engaging said drive member fully in a notch, said means for rotating said trip lever means thereafter releasing said trip lever means for sudden reverse rotation of said shaft by the biasing of said kick spring means.

12. Apparatus in accordance with claim 11 wherein said predetermined point of rotation permits full seated engagement of the drive member in the notch and further allows an arcuate movement of said disc and reel of a few degrees in a direction opposite the direction of spin just prior to the release of said trip lever means.

13. Apparatus in accordance with claim 11 wherein said trip lever means is rotated through an arc that is less than a full circle.

14. Apparatus in accordance with claim 13 wherein said trip lever means is rotated through an arc of approximately 45°.

15. Apparatus in accordance with claim 11 wherein said means for rotating said trip lever means includes a trip drive lever pivotally mounted on said shaft and having an extended portion at the outer end of which includes a pivotally mounted pawl having a first position which contacts said trip lever means and rotates it therewith when said trip drive lever is rotated against said trip lever, said pawl having a second position in which it is pivoted away from said trip lever means to free same for reverse rotation independent of said trip drive lever in response to bias on said expanded kick spring.

16. Apparatus in accordance with claim 15 further including adjustable stop means having a predetermined location to intercept a portion of said pawl and move it from its first position to its second position while said trip drive lever is rotating said trip lever means.

17. Apparatus in accordance with claim 11 wherein said means for rotating said trip lever means and said shaft includes a manually operated game handle and damping means intermediate said game handle and said trip lever means to limit the speed of rotation of said shaft and said means connected to said shaft for pivoting said drive lever means when said game handle is pulled with a yank.

18. Apparatus in accordance with claim 17 wherein said damping means includes a dashpot and a compression spring operating in conjunction with the dashpot to temporarily store energy in excess of energy absorbed by the resistance of the dashpot.

19. Apparatus in accordance with claim 3 further including a unitized support assembly mounting said apparatus, thus affording conversion of used game devices as well as assembly line production of new devices.

20. Apparatus for spinning and indexing a rotatable reel of the type used in an amusement or game device, comprising: a reel mounted for rotation;

a circular disc attached to said reel and having a plurality of notches located along the circumference of the disc, the notches being formed to receive a stop member for stopping rotation of and releasably holding the rotative position of the disc and reel and a drive member for imparting spin to the disc and reel;

an elongated index arm means having attachment means at one end of pivotally attaching said index arm means to a stationary support and having a stop member at the other end thereof for random engagement with any one of the notches when said index arm means is pivoted toward the disc;

means connected to the stationary support for retracting the stop member from engagement with the indexed notch, said means including an elongated bracket mounted on said index arm means and extending generally at right angles thereto in a direction away from the disc, a spring having one end connected to the distal end of said bracket and its other end connected to the stationary support at a location spaced away from the distal end of said bracket in a direction toward the disc, whereby the spring urges said stop member toward the disc, and a retraction lever means pivotally mounted at its midportion to the stationary support at the same location as the pivotal mounting of said elongated index arm means, one portion of said retraction lever means extending parallel to and adjacent said index arm means and another portion thereof extending parallel to said index arm means and beyond the mounting end, the portion of said retraction lever means adjacent said index arm means having a right angle extension that contacts the edge of said index arm means nearest the disc when that portion of the lever rotates away from the disc, and the portion of said retraction lever means extending beyond the pivotal mounting being connected to said interconnecting member for rotating that extension portion of the retraction lever in a direction toward the disc and thereby move said stop member out of engagement with the notch in the disc;

a shaft mounted for rotation and extending parallel to the axis of the reel and discs;

drive lever means pivotally mounted for independent rotation on said shaft and having a drive member at the distal end thereof for engagement with a notch when said drive lever means is pivoted toward the disc;

means connected to said shaft for pivoting said drive lever means toward and away from the disc;

means coordinating the pivoting of said drive lever means toward the disc for engagement thereof by the drive member with the retraction of the stop member from engagement with the disc to cause the drive member to be ready to seat in a notch before the stop member is disengaged from the indexed notch, whereby the disc and reel are not free to rotate during the transfer from engagement of the disc by the stop member to engagement of the disc by the drive member, said coordinating means including an interconnecting member that joins said stop member retracting means and said drive lever pivoting means;

means for permitting free rotation of the disc and reel when the drive member is thereafter moved out of engagement with the disc;

means for imparting spin to the disc and reel; and means for randomly indexing the disc and reel by causing the stop member to engage one of the notches after the disc and reel are in full spinning motion.

* * * * *

UNITED STATES PATENT AND TRADEMARK OFFICE

CERTIFICATE OF CORRECTION

PATENT NO. : 4,358,114

DATED : November 9, 1982

INVENTOR(S) : Walter M. Burnside

It is certified that error appears in the above-identified patent and that said Letters Patent is hereby corrected as shown below:

Column 4, line 48, after "mentioned" delete --,--.

Column 9, line 47, change "convenient" to --conventional--.

Column 15, line 20, delete "magnet".

Signed and Sealed this

*Eighteenth* Day of *October 1983*

[SEAL]

*Attest:*

GERALD J. MOSSINGHOFF

*Attesting Officer*

*Commissioner of Patents and Trademarks*